US005318260A

United States Patent [19]

Kemnitz

[11] Patent Number: 5,318,260

[45] Date of Patent: Jun. 7, 1994

[54] TABLE LEG BRACE ASSEMBLY

[75] Inventor: Glen D. Kemnitz, Gallatin, Tenn.

[73] Assignee: Sunbeam Corporation, Ft. Lauderdale, Fla.

[21] Appl. No.: 963,899

[22] Filed: Oct. 19, 1992

[51] Int. Cl.[5] ..... A47B 3/06

[52] U.S. Cl. ..... 248/188.91; 248/188; 108/153; 108/50

[58] Field of Search ..... 248/188.91, 188.1, 188.7, 248/188.8, 188; 108/153, 50, 160, 156, 157; 135/16

[56] References Cited

U.S. PATENT DOCUMENTS 2,952,306 9/1960 Adler ..... 248/188.91 X
3,826,206 7/1974 Ruggles ..... 108/153 X
4,353,659 10/1982 Comte ..... 108/50 X

*Primary Examiner*—Alvin C. Chin-Shue
*Attorney, Agent, or Firm*—Michael J. Kline; Darren E. Wolf

[57] ABSTRACT

A table leg assembly for a table top used for an indoor or outdoor table having two identical elongated plastic brace members used for interconnecting two legs at both ends of the brace members. A recess located at each end of the brace members is shaped and disposed to receive a table leg. Two legs are secured together to the preassembled brace members by screws extending through the brace members and the legs. Optionally, a central recess in each brace member forms an aperture for receiving an umbrella pole for an outdoor furniture table assembly. Several bosses and receptacles on the brace members cooperate to align and connect the two brace members together.

38 Claims, 3 Drawing Sheets

TABLE LEG BRACE ASSEMBLY

BACKGROUND OF THE INVENTION

1. Field of the Invention

The present invention relates to a support structure or a base for a table top for patio use. More particularly, it relates to a brace assembly for supporting and connecting legs of a table, and optionally, for receiving a pole of an umbrella.

2. Description of the Prior Art

Patio tables generally have support structures which constitute metal legs which are extruded tubing with a welded joint and welded to a circular metal brace member, which legs and circular brace member form a guide for receiving a pole of an umbrella.

An example of a table support construction for outdoor use is disclosed in U.S. Pat. No. 4,092,042,wherein a plurality of tubular legs constructed of steel tubing are banded together with a central post providing an open passage for receipt of an umbrella. The legs are positioned away from the central post by rings attached to the post by welding. These rings have peripheral notches which receive the legs. The post and legs are held together by steel bands tensioned by screws.

Other examples for a support or a base for a table top are disclosed in U.S. Pat. Nos. 2,467,080; 2,759,780; 3,074,771; 3,366,079; 3,738,287; 3,643,608; 3,934,519; 3,990,663; 4,003,320; and 4,700,915. Quite a number of these bases of the prior art require intensive labor especially those involving weldment of the several pieces.

In spite of the known bases or supports for a table top, there remains a very real and substantial need for a table support that is easily assembled without welding. There is also a need for a table support that not only provides connections for the legs but also a support for an umbrella pole.

SUMMARY OF THE INVENTION

The present invention has met the above-described needs. The present invention provides a system for supporting legs and optionally a pole of an umbrella for a patio table for indoor and outdoor use. The invention employs two similar or identical elongated brace members, which advantageously may be made of molded plastic.

The brace members have bosses and receptacles along their lengths which interlock to align the two members, and are secured together by self-threading screws received in the bosses and receptacles. The opposed ends of each brace member have an outwardly open recess which is disposed and shaped to receive a table leg. Two table legs are positioned into a respective recess at the opposed ends of the brace members, and are secured together and to the brace members by screws and nuts.

The brace members have a central projecting area, which, when the brace members are secured to each other, form a circular aperture for receiving the pole of an umbrella.

Accordingly, it is an object of the present invention to provide a table leg brace assembly for supporting legs and a post of an umbrella for a patio table which is easy to assemble, and which eliminates the need for weldment of the parts.

It is a further object of the invention to provide a table leg brace assembly which stabilizes the table.

It is a further object of the invention to provide a table leg brace assembly which ties the legs together and which provides a guide for a post of an object extending through the table top.

It is a further object of the invention to provide plastic molded brace members for a support assembly for a table.

It is a further object of the present invention to provide a brace assembly for supporting legs for a table top which is easy to assemble, and which eliminates the need for weldment of the parts.

It is still a further object of the present invention to provide a brace assembly which secures two legs together at its opposed ends.

It is a further object of the invention to provide a brace assembly for supporting legs for a table top which secures at least two legs together at its opposed ends by fastening means which extend through the legs and the brace members.

These and other objects of the present invention will be more fully understood and appreciated from the following description of the invention on reference to the illustration appended thereto.

DETAILED DESCRIPTION OF THE PREFERRED EMBODIMENT

Figure 1:
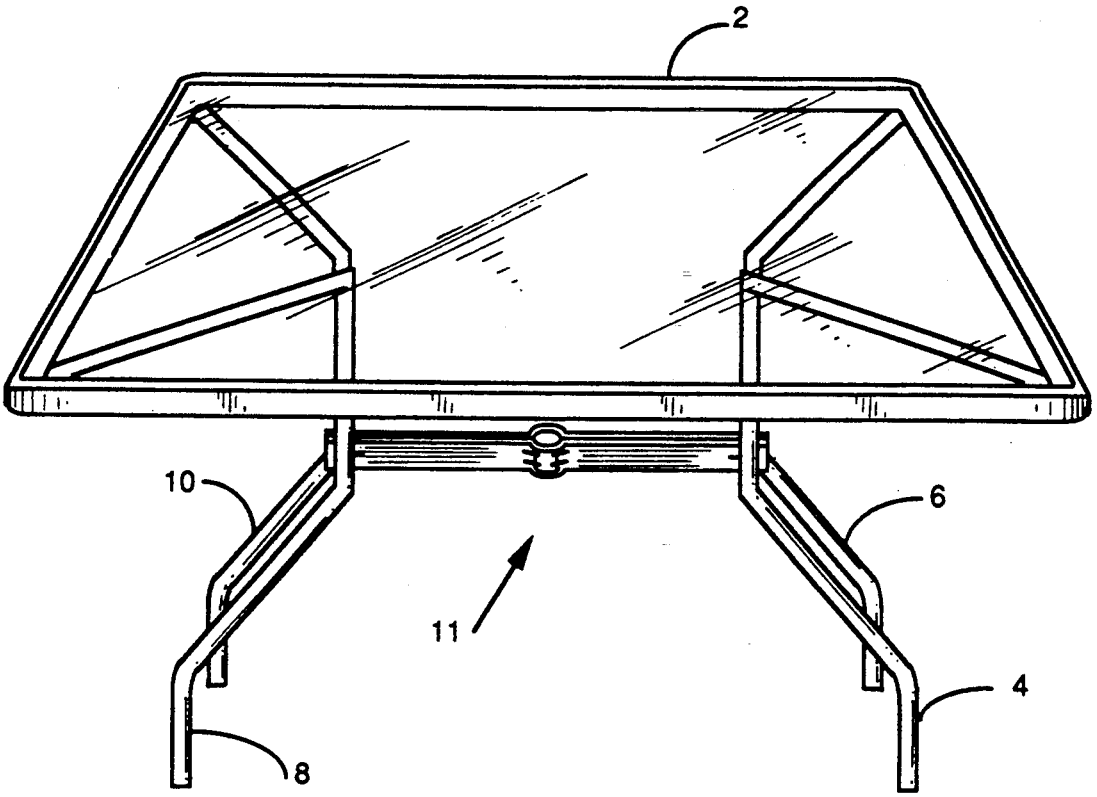
FIG. 1 is an isometric view of an assembled table incorporating the present invention.

Referring first to FIG. 1 there is shown an assembled patio table with a table top 2, legs 4, 6, 8, and 10, and a brace assembly 11 which can be used on other table styles, particularly a table with an elongated table top. Table top 2 is supported by legs 4–10, (even numbers only) as shown in FIG. 1 through means known in the art, whereby legs 4–10 are secured in the rim extrusion which also supports table top 2.

Figure 2:
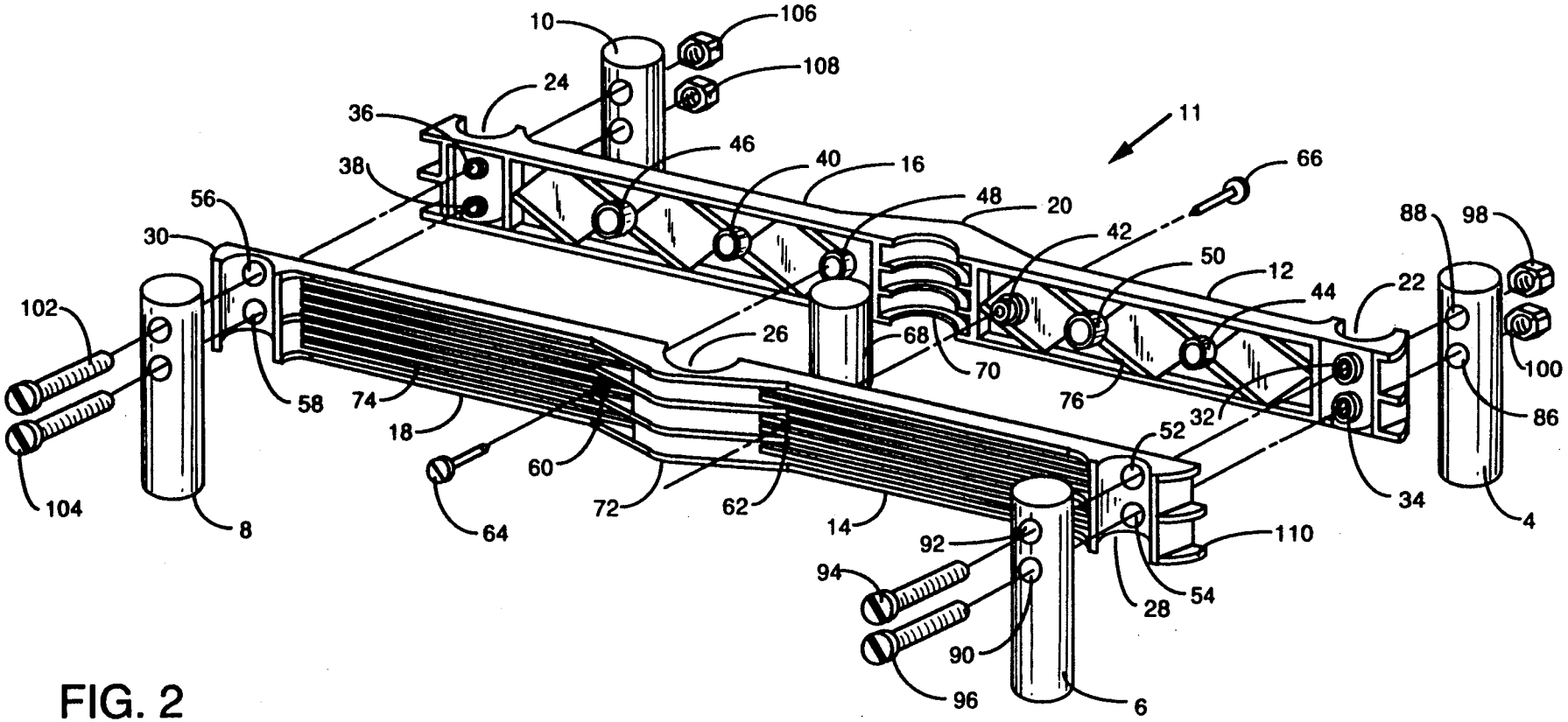
FIG. 2 is an exploded, isometric view of the present invention.

Referring particularly to FIG. 2, brace assembly 10 has two elongated brace members 12 and 14, which, preferably, are made of plastic and are molded by a process obvious to those skilled in the art. An example of the type of plastic would be acrylate butyl styrene "T" grade, and an example of the molding process would be injection molding.

Each brace member 12, 14 has a body portion 16, 18, respectively. Body portion 16 has a central section 20 and two opposed ends 22 and 24, and body portion 18 has a central section 26 and two opposed ends 28 and 30. Referring particularly to brace member 12, opposed end 22 has receptacles 32 and 34, and opposed end 24 has bosses 36 and 38.

Along body portion 16 of brace member 12 are several bosses alternating with several receptacles. The bosses are shown at numerals 40, 42, and 44, and the receptacles are shown at numerals 46, 48, and 50.

Both brace members 12 and 14 are identical. In FIG. 2, member 14 is turned 180 degrees relative to member 12. In effect, the several receptacles and bosses of brace member 14 are arranged opposite to those shown for brace member 12. That is, opposed end 28 of brace member 14 even though not clearly shown has bosses indicated at numerals 52 and 54, which are received in receptacles 32 and 34, respectively, of the opposed end 22 of brace member 12.

Opposed end 30 of brace member 14 has receptacles indicated at numerals 56 and 58 for receiving bosses 36 and 38, respectively, of opposed end 24 of brace member 12. A boss indicated at 60 in body portion 18 of member 14 is received in receptacle 48 of brace member 12, and a receptacle indicated at 62 in brace member 14 receives boss 42 of brace member 12.

Even though not shown in FIG. 2 corresponding bosses and receptacles are provided on brace member 14 which cooperate with receptacles 46, 50 and bosses 40, 44 of brace member 12. The bosses 36, 38, 52 and 54, and the receptacles 32, 34, 56, and 58 in the opposed ends 22, 24, 28 and 30 as well as bosses 42 and 60, and receptacles 48 and 62 of members 12 and 14 have through holes for receiving fastening means, more about which will be discussed hereinafter.

Figure 4:
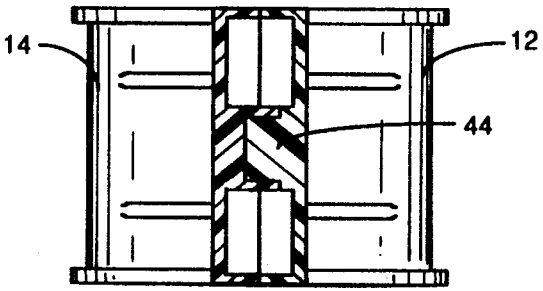
FIG. 4 is a section view taken along lines 4—4 of FIG. 3.

For assemblage of brace members 12 and 14, the brace members 12 and 14 are brought together until the bosses in both members are received in a cooperating receptacle of members 12 and 14 for a slip fit. Such a connection is best shown in FIG. 4.

Referring particularly to FIG. 2, fastening means, such as screw 64 shown to the left of the central aperture with respect to brace member 14 is inserted into boss 60 of member 14 and receptacle 48 of member 12, and screw 66 shown to the right of central aperture with respect to brace member 14 is inserted into boss 42 of member 12 and receptacle 62 of member 14. Both screws 64 and 66 are self-threading and affix members 12 and 14 together.

Central portions 20 and 26 of members 12, 14, respectively, project outwardly and have an inwardly open arcuate recess which when members 12 and 14 are assembled together form a central aperture or opening for receiving a pole 68 of an umbrella which pole 68 is only shown in FIG. 2. Both central portions 20 and 26 of members 12 and 14, respectively, have several ribs which extend on the inward and outward surfaces of brace members 12 and 14. These ribs, an inward rib indicated at numeral 70 and an outward rib indicated at 72, for brace members 12 and 14, add strength to the central aperture formed by members 12 and 14. Preferably, the central aperture formed by members 12 and 14 is larger than umbrella pole 68 in order to allow pole 68 to pass freely through the central aperture formed by members 12 and 14. It is to be appreciated that legs 4–10 and pole 68 are shortened in FIG. 2 for simplicity.

Figure 3:
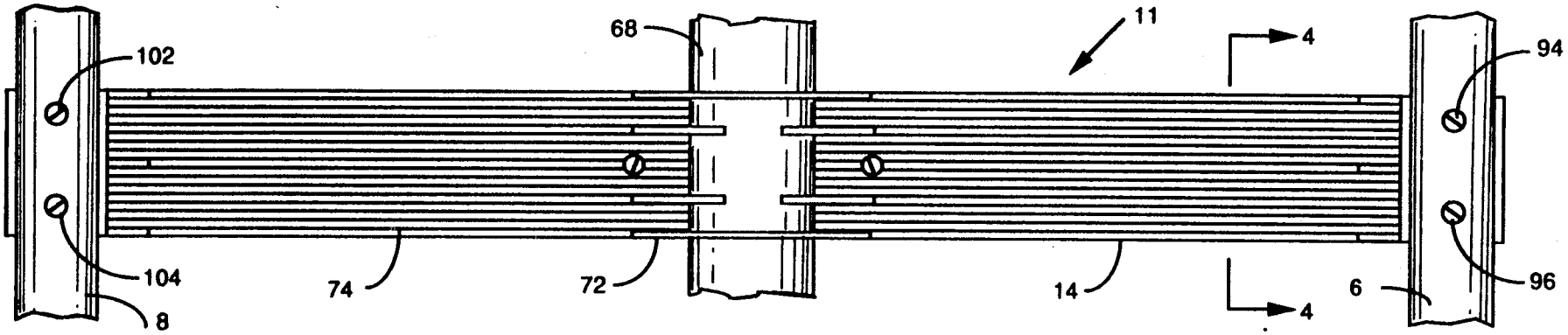
FIG. 3 is a side elevational view showing the two brace members of the present invention with the table legs and umbrella pole in assembled form.

Brace members 12 and 14 have several longitudinal strengthening ribs on their outward surface, one of which is indicated by numeral 74 for member 14. There are also several outwardly projecting ribs in an arcuate or circular configuration, one of which is indicated by numeral 72. These arcuate ribs 72 add strength to the central aperture which receives umbrella pole 68. These arcuate ribs 72 and the longitudinal ribs 74 are best shown in FIG. 3. Referring again to FIG. 2, several support members are arranged in a diagonal fashion on the inward longitudinal surface of members 12 and 14. One of such ribs is indicated by numeral 76 on member 12. These diagonal ribs form a webbing or waffling and add strength to brace members 12 and 14. When assembled, brace members 12 and 14 join table legs 4, 6, 8, and 10, and provide the stability which allows the table of FIG. 1 to function and support weight placed on table top 2.

The opposed ends 22, 24, 28 and 30 of brace members 12 and 14, respectively, are an integral part of brace members 12 and 14. Each opposed end 22, 24, 28, and 30 has a recessed portion, which is apparent in FIG. 2 and which is in the form of an arc or a semi-circle for receiving their respective leg 4, 6, 8, and 10.

More particularly, leg 6 is placed in the semicircular recess of opposed end 22 of member 12, and leg 4 is placed into the semi-circular recess of opposed end 28 of member 14. Both legs 4 and 6 have holes as indicated at 86, 88, 90 and 92, for receiving threaded screws 94 and 96.

Screw 94 is inserted through hole 92 of leg 4, through boss 52 of opposed end 28 of member 14, through receptacle 32 of opposed end 22 of member 12, and through hole 88 of leg 6, and is secured thereto by nut 98.

Screw 96 is inserted through hole 90 of leg 4, through boss 54 of opposed end 28 of member 14, through receptacle 34 of opposed end 22 of member 12, and through hole 86 of leg 6 and is secured thereto by nut 100.

Similar assemblage of legs 8 and 10 occur on opposed ends 24 and 30 of members 12 and 14, respectively. That is, screws 102, 104 and nuts 106, 108 secure legs 8 and 10 in their respective arcuate recesses of opposed ends 24 and 30 of members 12 and 14 in a manner similar to that explained hereinbefore for the assembling or connecting of legs 4 and 6 to brace members 12 and 14.

As can be seen in FIG. 2, opposed ends 22, 24 of member 12 and opposed ends 28, and 30 of member 14 have several ribs on both sides of their recesses, one of which ribs is indicated by numeral 110 to the far right of FIG. 2 for strengthening the arcuate recesses formed in opposed ends 22, 24, 26, and 28 of brace members 12 and 14.

The bosses and receptacles of brace members 12 and interlock the brace members to keep them aligned for the assembling and securing of legs 4, 6, 8 and 10 in brace assembly 11. This particular arrangement and assemblage of brace assembly 11 with legs 4–10 as stated hereinbefore adds stability to the table top 2 of FIG. 1.

It is to be appreciated that for simplicity only a portion of legs 4–10 is shown in FIG. 2, but that these legs 4–10 are similar to those shown in FIG. 1. It is also to be appreciated that even though legs 4–10 are round, and the recesses formed at ends 22, 24, 26, and 28 for receiving legs 4–10 are arcuate, that the legs could be square and the recesses could be square cornered to accept the square legs.

Legs 4–10 can be made of metal, plastic, wood or composite materials. It is to be appreciated that brace assembly 11 joins legs 4–10 connected thereto and provides stability to the table assembly.

For convenience of disclosure herein, reference has been made specifically to a patio table having a table top for receiving a pole of an umbrella, as particularly illustrated in FIG. 2, but it will be appreciated that the concept can be applied to other types of tables, or to other types of furniture, or to other configurations of table tops, such as square, oval, etc., or to other sizes of tables.

Whereas particular embodiments of this invention have been described above for purposes of illustration, it will be evident to those persons skilled in the art that numerous variations of the details of the present invention may be made without departing from the invention as defined in the appended claims.

In accordance with the provisions of the patent statutes, I have explained the principles and operation of my invention, and have illustrated and described what I consider to represent the best embodiment thereof.

I claim:

1. A table leg brace assembly, comprising:

a plurality of legs, and elongated brace means consisting of a pair of brace members connected to each other and having adjacent to the free ends thereof outwardly open leg receiving recesses, each of said legs being secured within one of said leg receiving recesses.

2. A table leg brace assembly of claim 1, wherein said each of said legs has a dimension corresponding to that of said each of said leg receiving recesses.

3. A table leg brace assembly of claim 1, wherein each of said legs has an external curvilinear surface, and wherein said each of said leg receiving recesses has an internal curvilinear surface corresponding to the external curvilinear surface of said each of said legs.

4. A table leg brace assembly of claim 1, further comprising:

fastener means extending through at least two of said legs and said brace means.

5. A table leg brace assembly of claim 1, wherein each of said brace members has a plurality of bosses and receptacles and said pair of brace members are joined together by said plurality of bosses and receptacles, whereby each of said bosses is received in one of said receptacles.

6. A table leg brace assembly of claim 5, wherein several of said bosses and receptacles have a slip fit.

7. A table leg brace assembly of claim 5, further comprising fastener means extending through several of said bosses with their respective receptacle.

8. A table leg brace assembly of claim 5, wherein said each of said brace members has an inwardly open arcuate recess which forms an aperture for receiving a pole of an umbrella.

9. A table leg brace assembly of claim 8, wherein said arcuate recess of said each of said brace members has inwardly projecting arcuate rib means for strengthening said aperture.

10. A table leg brace assembly of claim 5, wherein said each of said brace members are identical.

11. A table leg brace assembly of claim 10, wherein one of said elongated brace members is disposed about 180° relative to the other of said elongated brace members.

12. A table leg brace assembly of claim 5, wherein said each of said brace members has an outward surface with longitudinal strengthening ribs on said outward surface.

13. A table leg brace assembly of claim 5, wherein said each of said brace members has an inward surface with strengthening ribs thereon.

14. A table leg brace assembly of claim 1, wherein said elongated brace means are molded plastic.

15. A table leg brace assembly of claim 1, wherein said elongated brace means has longitudinal strengthening rib means.

16. A table leg assembly of claim 1, wherein said brace means has a pair of brace members joined together, and wherein each of said leg receiving recesses of said brace means has at least one boss or one receptacle which interfit with a boss or a receptacle of a cooperating leg receiving recess, and further includes fastener means extending through a cooperating boss and receptacle of said each of said recesses and their respective legs for securing at least two said legs and one of said free ends of said pair of brace members together.

17. A table leg brace assembly of claim 1, wherein said elongated brace means has an outward surface which contains said open leg receiving recesses, and rib means along said recesses extending on said outward surface for strengthening said recesses.

18. A method of assembling a table leg brace assembly, the steps comprising:

providing a plurality of legs, and providing elongated brace means consisting of a pair of brace members connected to each other and having outwardly open leg receiving recesses adjacent to the free ends thereof, and disposing one of said plurality of legs in one of said leg receiving recesses, and securing said one of said plurality of legs in its respective leg receiving recess.

19. A method of claim 18, wherein said each of said legs are round and have a radius, the steps further comprising:

forming a radius in each of said open leg receiving recesses of said elongated brace means to correspond with the radius of said each of said legs.

20. A method of claim 18, the steps further comprising:

securing at least two legs together in their respective leg receiving recesses.

21. A method of claim 18, the steps further comprising:

providing a plurality of bosses and receptacles on each of said brace members, and joining said brace members together in a manner each of said bosses is received in one of said receptacles to form a coupling, and a recess in one of said brace members abuts a recess in the other of said brace members.

22. A method of claim 21, the steps further comprising:

providing a slip fit between said each of said bosses with their respective receptacle.

23. A method of claim 21, the steps further comprising:

employing fastener means through each said coupling.

24. A method of claim 21, the steps further comprising:

providing an inwardly open arcuate recess in each of said brace members which forms an aperture for receiving a pole of an umbrella when said two brace members are joined together.

25. A method of claim 24, the steps further comprising:

providing inwardly projecting arcuate rib means in said recess of said each of said brace members for strengthening said aperture.

26. A method of claim 21, the steps further comprising:

providing identical brace members.

27. A method of claim 26, the steps further comprising disposing one of said brace members about 180°relative to the other of said brace members.

28. A method of claim 18, wherein said brace means are plastic.

29. A method of claim 18, the steps further comprising:

providing longitudinal strengthening rib means on said brace means.

30. A method of claim 18, the steps further comprising:

for each of said leg receiving recesses of said brace members, providing at least one boss or one receptacle, joining said brace members together so that said one boss or said one receptacle interfits with a boss or receptacle of a cooperating leg receiving recess, and extending fastener means through a cooperating boss and receptacle of said each of said recesses and their respective legs for securing at least two said legs and one of said free ends of said pair of said brace members together.

31. A table leg brace assembly, comprising:

a plurality of table legs, and elongated brace means consisting of a pair of brace members connected to each other and having adjacent to the free ends thereof outwardly open leg receiving recesses, each of said legs being secured within one of said leg receiving recesses, each of said brace members having a plurality of bosses and receptacles and said pair of brace members are joined together by said plurality of bosses and receptacles, whereby each of said bosses is received in one of said receptacles.

32. A table leg brace assembly of claim 31, further comprising:

fastener means extending through at least two of said legs and said brace means.

33. A table leg brace assembly of claim 31, wherein each of said brace members has an inwardly open arcuate recess which forms an aperture for receiving a pole of an umbrella.

34. A table leg brace assembly of claim 31, wherein said elongated brace means are molded plastic.

35. A method of assembling a table leg brace assembly, the steps comprising:

providing a plurality of table legs, and providing elongated brace means consisting of a pair of brace members connected to each other and having outwardly open table leg receiving recesses adjacent to the free ends thereof, and disposing one of said plurality of table legs in one of said table let receiving recesses, and securing one of said plurality of table legs in its respective table leg receiving recess, and providing a plurality of bosses and receptacles on each of said brace members, and joining said brace members together in a manner whereby each of said bosses is received in one of said receptacles to form a coupling, and a recess in one of said brace members abuts a recess in the other of said brace members.

36. A method of claim 35, the steps further comprising:

employing fastener means through each said coupling.

37. A method of claim 35, the steps further comprising:

providing an inwardly open arcuate recess in each of said brace members which forms an aperture for receiving a pole of an umbrella when said two brace members are joined together.

38. A method of claim 35, wherein said brace members are plastic.

* * * * *